United States Patent [19]

Mulvenna

[11] 4,242,053

[45] Dec. 30, 1980

[54] FREE PISTON FLUID ENERGY TRANSFER DEVICE

[76] Inventor: Charles A. Mulvenna, Kingston, Ontario, Canada

[21] Appl. No.: 865,317

[22] Filed: Dec. 28, 1977

[30] Foreign Application Priority Data

Dec. 22, 1977 [CA] Canada ..... 293772

[51] Int. Cl.[3] ..... F04B 19/02

[52] U.S. Cl. ..... 417/211; 417/328; 417/241; 91/61

[58] Field of Search ..... 417/241, 328, 240, 211; 185/4, 27; 91/61

[56] References Cited

U.S. PATENT DOCUMENTS

| | | | |
|---|---|---|---|
| 2,019,023 | 10/1935 | Seilliere | 417/328 |
| 3,465,684 | 9/1969 | Moll | 417/328 |
| 3,941,515 | 3/1976 | Alstin | 417/240 |
| 3,945,763 | 3/1976 | Terhune | 417/328 X |

FOREIGN PATENT DOCUMENTS

| | | | |
|---|---|---|---|
| 536323 | 2/1977 | U.S.S.R. | 417/328 |

OTHER PUBLICATIONS

Robert Moll, The Free Piston Pump, Mar. 1971, Hydraulic Pneumatic Power.

*Primary Examiner*—Richard E. Gluck

*Attorney, Agent, or Firm*—Larson, Taylor and Hinds

[57] ABSTRACT

The specification describes a fluid energy transfer device, comprising: a body means having at least one fluid chamber and fluid inlet and outlet passages for delivering fluid to and from the chamber; means for continuously accelerating the body means; whereby acceleration of the body means causing fluid flow inwardly and outwardly of the chamber and a change in fluid flow rate being effective to change the acceleration of the body means.

52 Claims, 12 Drawing Figures

FREE PISTON FLUID ENERGY TRANSFER DEVICE

This invention relates to an energy transfer device of the fluid displacement type.

More particularly, this invention is directed to an alternative method of transferring fluid energy and is applicable to fluid motors and pumps as well as gas engines and compressors. Generally, the pressure of a fluid may be varied by accelerating the body containing the fluid or, alternatively, the velocity of the body may be altered by varying the pressure of the fluid within the body.

Thus, the present invention may be broadly defined as a fluid energy transfer device, comprising: a body means having at least one fluid chamber and fluid inlet and outlet passages for delivering fluid to and from the chamber; means for continuously accelerating the body means; whereby acceleration of the body means causing fluid flow inwardly and outwardly of the chamber and a change in fluid flow rate being effective to change the acceleration of the body means.

It should be understood at the outset that the term "acceleration" is intended to include both positive and negative changes in velocity and that the changes in velocity may be caused by altering either or both the speed and direction of the body means.

The body means will have a displacer means which may simply be a fluid, including both gas and liquid, but in practice will include a piston to provide greater mass and inertial effects. However, a piston is not essential especially when dealing with a liquid.

As suggested above, the body means may be arranged to move along a straight line between two positions. By causing the body means to move between the two positions, the velocity of the body means will change from a maximum at some intermediate position, to zero at the two end positions. If the body is formed with an internal fluid chamber and fluid inlet and outlet passages leading to and from the chamber, and appropriate valving is provided in the passages, fluid may be caused to flow from the inlet to the outlet via the chamber in response to acceleration of the body means. This is achieved by virtue of the inertial mass of the displacer means. Thus, the velocity of the body in this situation is varied by changing the speed.

The same effects may be obtained by changing only the direction of the body means. This may be achieved by rotating the body means about an axis in such a manner that the body means maintains a substantially fixed attitude with respect to a fixed frame of reference, or such that the axis of the body means remains substantially parallel to a fixed axis. In this configuration, the displacer means is arranged to be movable in a direction substantially perpendicularly to the axis of rotation of the body means.

One aspect of the present invention is directed to various alternative means of causing the body means to rotate in accordance with the above-described constraints while another aspect of the invention is directed to means of providing fluid inlet and outlet passages to and from the moving body means.

These and other features of the invention will become clear from the description which follows in which reference is made to the appended drawings wherein.

Figure 5:
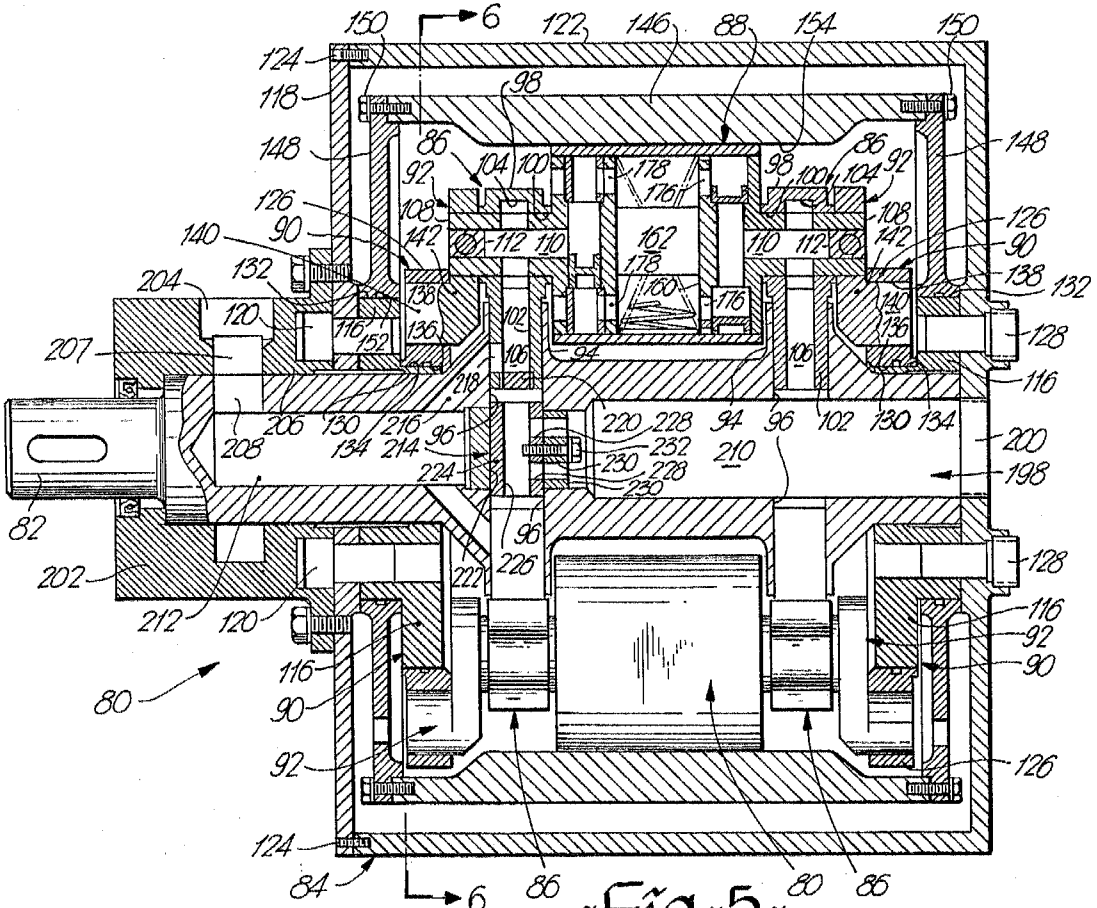
FIG. 5 is a longitudinal cross-sectional view of a practical embodiment of the invention.
Figure 12:
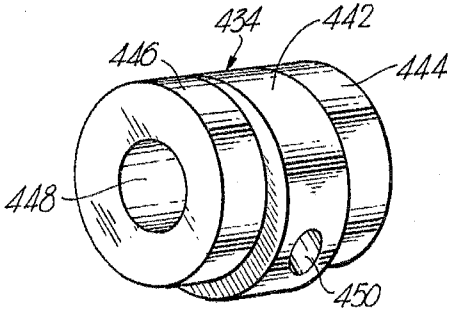
Figure 10:
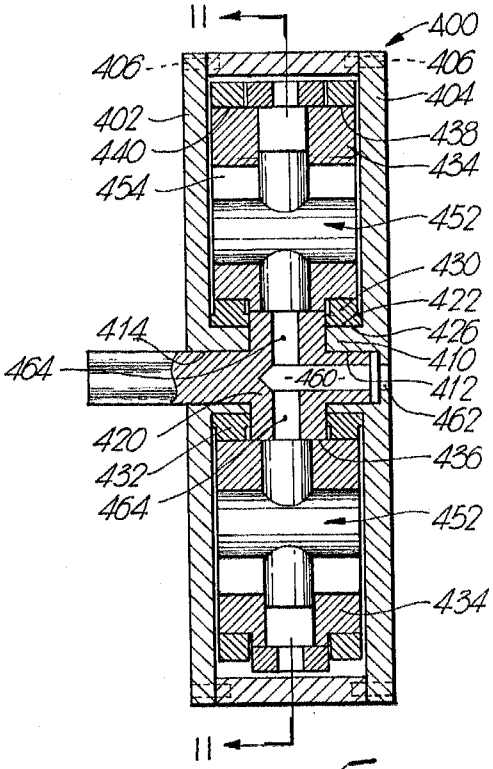
FIG. 10 is a longitudinal cross-sectional view of still another practical embodiment of the invention.

FIG. 12, adjacent FIG. 5, is a perspective view of the body means of the embodiment of FIG. 10.

Figure 1:
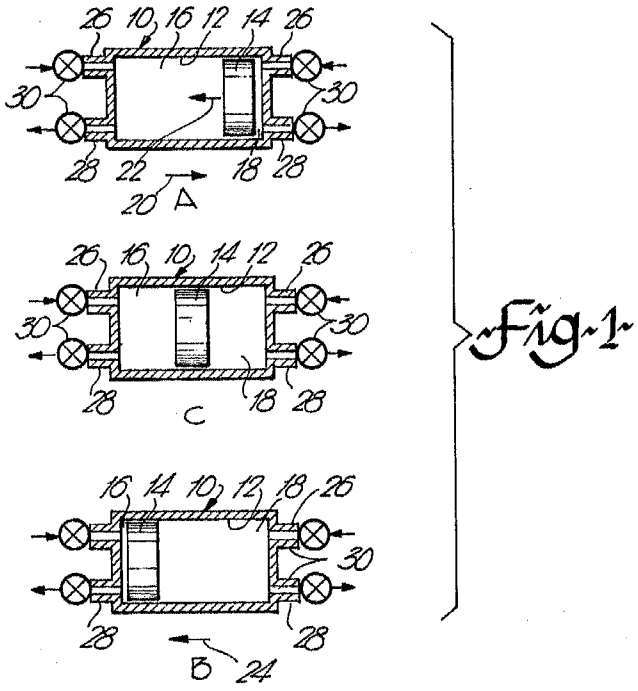
FIG. 1 is a diagrammatic illustration of one aspect of the invention, wherein a body means is movable along a linear path.
Figure 2:
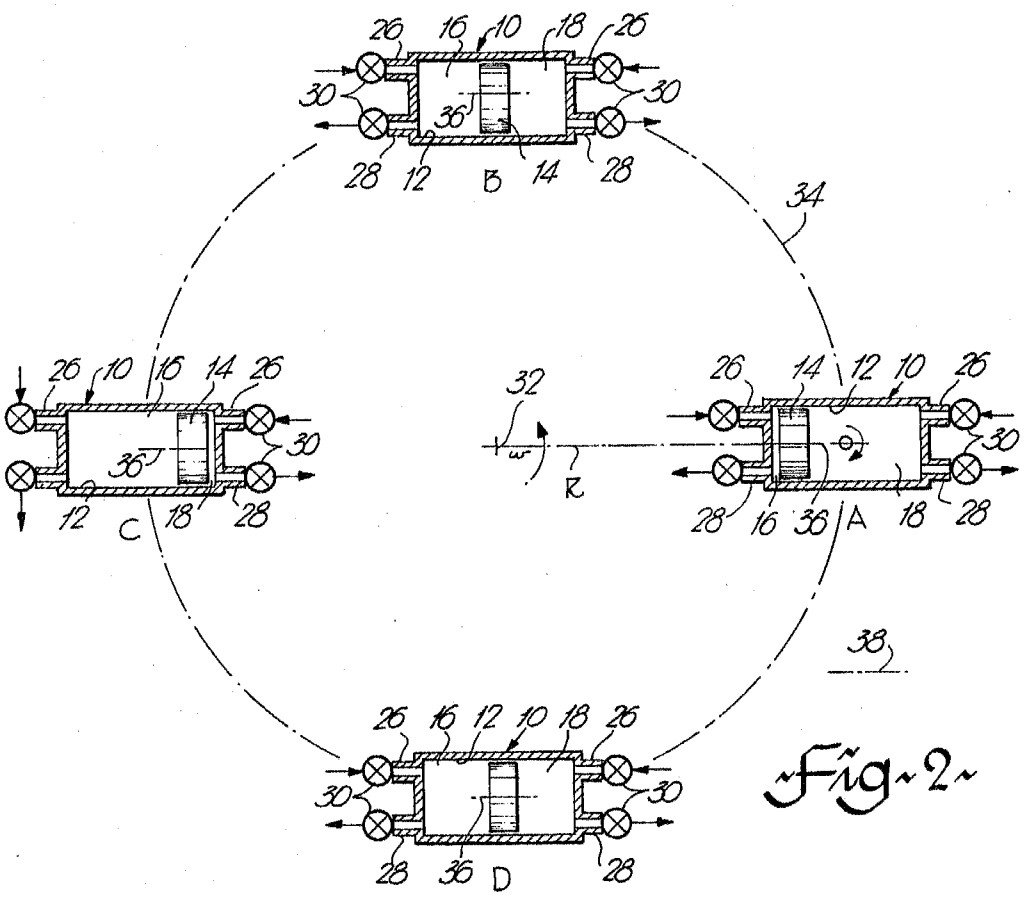
FIG. 2 is a diagrammatic illustration of a second aspect of the invention wherein a body means is movable along a circular path.

Two aspects of the invention are diagrammatically illustrated in FIGS. 1 and 2. In FIG. 1, a body means 10 is constrained for movement in a straight line while in FIG. 2 the body means 10 is constrained for movement in a circular path in a specific manner to be described later.

With reference to FIG. 1, the body means 10 is formed with an internal cavity or bore 12 in which a displacer means 14 is mounted for free sliding movement therein in response to acceleration of the body means. As suggested earlier, the displacer means may be a gas, liquid, or one of these and a piston means 14. For ease of understanding, reference will be made to a piston means 14 which defines with the body means 10 a pair of chambers 16 and 18.

The body means is constrained for movement along a straight line between positions A and B. A midpoint position C is also illustrated in FIG. 1. Assuming body means 10 to be initially in position A and the piston means 14 to be at the right hand end of bore 12, acceleration of the body means 10 to the right in the direction of arrow 20 will cause piston means 14 due to its inertial mass, to move to the left in the direction of arrow 22 relative to body means 10. This will cause the volume of chambers 16 and 18 to change. Particularly, the volume of chamber 16 will decrease while that of chamber 18 will increase. In position C, the piston means 14 is shown to be midway in the bore 12 while in position B the piston means is at the leftmost end of bore 12 wherein the volume of chamber 16 is at a minimum and that of chamber 18 is at a maximum.

If, at position B, the direction of the body means 10 is reversed, the piston means 14 will, due to its inertial mass, move to the right relative to the body means thereby causing the volume of chambers 16 and 18 to again vary, that is, the volume of the chamber 16 increasing and that of chamber 18 decreasing. Continued acceleration of the body means 10 to the left in the direction of arrow 24 will cause the piston means 14 to have moved to the right hand end of bore 12 by the time the body means has returned to position A.

It will be understood that the stroke of the piston may well depend upon a number of factors such as the mass of the piston means, the acceleration of the body means, the coefficient of friction between the body means and the piston means and the pressures in chambers 16 and 18. It will also be understood that various alternative means may be provided for guiding the body means for straight line motion and for accelerating it between positions A and B. Still further it will be understood that the relative positions of the piston means and body means may be reversed. That is, the piston means may be the body which is accelerated and the body means formed with a bore in which a displacer means is positioned to define fluid chambers. These alternative configurations will be apparent to those skilled in such matters.

With reference once again to the embodiment of FIG. 1, each chamber 16 and 18 may be provided with fluid inlet and outlet passages 26 and 28, respectively. Each inlet passage 26 is connected to a source of fluid (not shown) and each outlet passage 28 is connected to an external fluid circuit (not shown). It will be seen that the changes in the volume of chambers 16 and 18 will, in this configuration, cause alternating fluid flow into and out of the chambers thereby simulating an AC generator.

Each fluid passage may be provided with fluid rectifiers 30 permitting fluid flow in one direction and preventing or restricting fluid flow in the opposite direction. In this configuration, the device will function as a pump causing a net flow of fluid outwardly via the outlet passages 28.

The device may be caused to motor if the pressures in chambers 16 and 18 is caused to vary. Thus, if in position C, the pressure in chamber 16 is suddenly increased relative to that of chamber 18, the piston means 14 will be forced to the right relative to the body means 10 and cause a force to be applied to the body means 10 and its velocity to be altered.

It will be seen therefore that the device is susceptible to a wide range of applications which will be apparent to those skilled in these matters.

Reference will now be made to FIG. 2 which diagrammatically illustrates a device identical in operation to that of the embodiment of FIG. 1, and, therefore, susceptible to all of the applications of the FIG. 1 embodiment, but wherein the acceleration of the body means is imparted by changing the direction rather than the speed of the body means 10.

Since this device is identical to that of FIG. 1, the same reference numerals have been used to designate the same elements. Thus, the device includes a body means 10 having a bore 12, a displacer means 14 mounted in the bore 12 for free sliding movement therein, the displacer means defining with the body means a pair of opposed fluid chambers 16 and 18, each chamber having an inlet passage 26 and an outlet passage 28 and appropriate fluid rectifiers 30 in the passages.

In this embodiment, the body means 10 is caused to rotate in a counterclockwise direction about axis 32 along the path of dotted line 34 at a constant angular velocity $\omega$. As with the previous arrangement, the body means is arranged such that the displacer means is displaced in response to acceleration of the body means. In this case, a centripetal force in addition to the inertial mass of the displacer means is effective to displace the displacer means or, for simplicity, the piston means. It will be seen that when fluid is trapped in the chambers the piston means will be forced to move with the body 10 in a circular path. This requires a centripetal acceleration of the piston which results in a high fluid pressure on one end of the piston means. The pressure in one chamber will be higher than the pressure in the other chamber for half a revolution and vice-versa.

As mentioned earlier, the body means is caused to rotate in a specific manner. More specifically, the line of motion 36 of the piston means 14 must be maintained substantially fixed with respect to a fixed frame of reference or, in other words, parallel to a fixed axis 38. It is inconsequential whether the line of motion is radial with respect to the axis 32 or perpendicular to it as evidenced by FIG. 2 and as will become clear later as long as it remains substantially fixed with respect to axis 38. Indeed the direction of the line of motion of the piston means will continuously changed with respect to the axis 32. Assuming the body means 10 is mounted for pivotal movement upon the outer end of an arm R, it will be seen that the body means 10 will rotate about its mounting in the opposite direction from that about axis 32. Thus, if the body means 10 rotates in a counterclockwise direction about axis 32 at an angular velocity $\omega$, every point on the body means must rotate in a clockwise direction about the end of arm R at the same angular velocity $\omega$ to achieve optimum pumping or motoring effects.

With these thoughts in mind, the operation of the device should be clear. It will be understood that the effect of moving body means 10, with piston means 14 the position shown in FIG. 2, from position A to position C in FIG. 2 is identical to that of moving the body means from position B to position A in FIG. 1. Similarly, the effect of moving the body means 10 from position C to position A in FIG. 2 is identical to moving the body means from position A to position B in FIG. 1. Positions B and D in FIG. 2 correspond to position C in FIG. 1. Accordingly, it is not deemed necessary to repeat the description at this point.

An advantage of the embodiment of FIG. 2 over that of FIG. 1, is that the device may be made more compact and balanced. Indeed a plurality of body means 10 may be made to move along the same path 34. Thus, a body means may be placed in each of positions A, B, C and D. It is desirable for load balancing purposes, among others, that the various body means be equally angularly spaced about the axis 32.

Having thus described the basic operation concepts of the invention, the description will now turn to particular means for rotating the body means in such a manner as to maintain the line of motion of the displacer means substantially fixed with respect to a fixed frame of reference and providing fluid flow passages to and from the fluid chambers.

With regard to fluid chambers, it must be remembered that the device is operative with only one chamber although a pair of opposed chambers separated by the piston means, to impart greater mass, is preferred. Indeed if the displacer means is a fluid, it will be seen to be affected in precisely the same manner as the piston means, that is move from one end to the other of the bore 12 in response to acceleration of the body means 10. In this arrangement, however, only one fluid passage need be provided at each end of the chamber defined by bore 12.

A large variety of schemes may be conceived for causing the line of motion of the displacer means to remain substantially constant with respect to a fixed frame of reference. These schemes are based on the concept of a four-bar linkage. This concept is diagrammatically illustrated in FIGS. 3 and 4.

Figure 3:
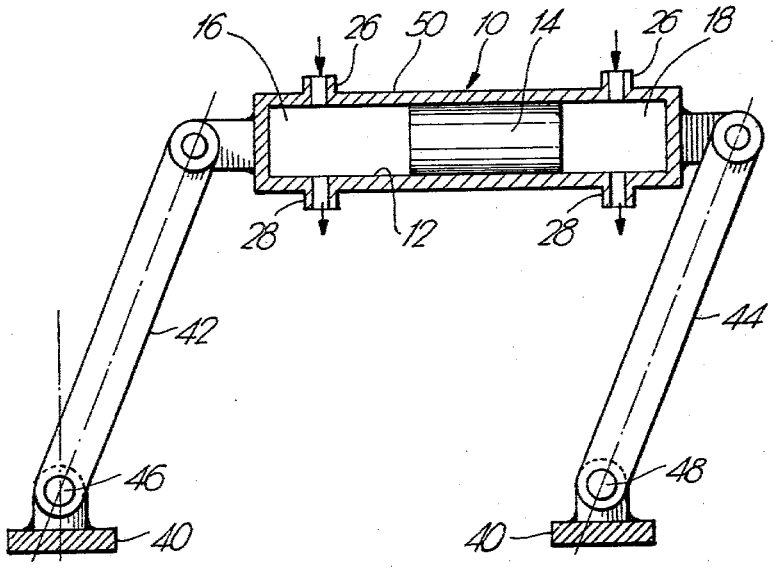
FIG. 3 is a diagrammatic illustration of a specific manner of rotating the body means of FIG. 2.

As illustrated in FIG. 3, a four-bar linkage is comprised of a frame 40, a pair of parallel arms 42, 44 of equal length, mounted for rotation at one of their ends on frame 40 about spaced parallel axes 46 and 48 and a link 50, defined by body means 10, pivotally mounted at each of its ends upon the other ends of arms 42 and 44. Thus, if one of arms 42 or 44 is caused to rotate about is respective axis on frame 40, the rigid nature of the frame, arms and link will ensure that arms 42 and 44 remain parallel to one another and link 50 remains parallel to a line extending between the two axis 46 and 48. It is seen, therefore, that a four-bar linkage concept provides a means by which the line of motion of the displacer means is made to remain constant with respect to a fixed frame of reference provided the body means constitutes the link and the line of motion of the displacer means is parallel to a line extending between the axis about which the two arms rotate.

Rotation of the arms 42 and 44 about their respective axes 46 and 48 will cause the body means 10 to operate in the manner described with reference to FIG. 2 which is identical to that of FIG. 1. Accordingly, repetition of that description is not deemed necessary at this point. However, the various reference numerals utilized in FIGS. 1 and 2 referrable to the elements of the body means 10 have been included in FIG. 3.

It will be understood that the arms 42 and 44 in FIG. 3, would by necessity include crankarms (not shown) in order to be operative. This, again, would be apparent to those skilled in the art.

Figure 4:
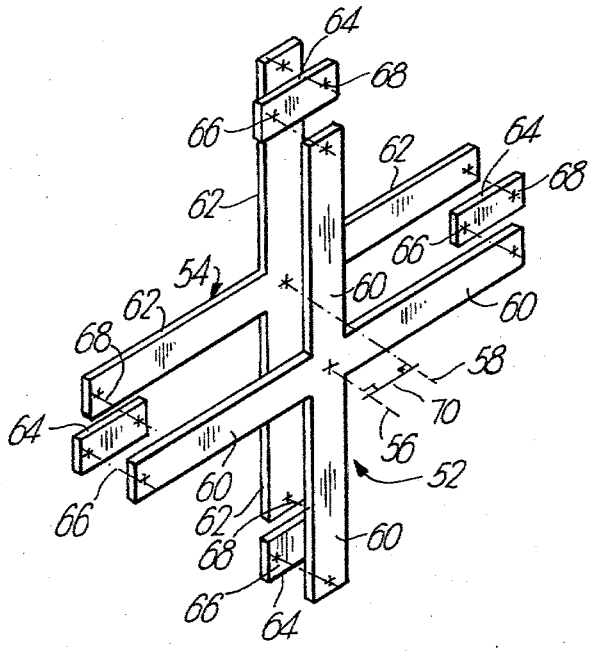
FIG. 4 is a diagrammatic illustration of a specific manner of rotating a plurality of body means.

The mechanism of FIG. 3, as described with reference to FIG. 2, may be adapted to include a plurality of links 50 which constitute the body means 10. Thus, FIG. 4 illustrates a pair of rotary members 52 and 54 rotatable about spaced, parallel axes 56 and 58, respectively. Rotary member 54 may be considered to be eccentric with respect to rotary member 52. Each rotary member includes a plurality of radially, outwardly extending arms of equal length at the ends of each of which is mounted one end of a link. Members 52 and 54 thus each include four equally, angularly spaced arms 60 and 62. Each arm of one rotary member is parallel to and of equal length as that of one of the other member and corresponding arms are interconnected by a link 64, constituting a body means, in the manner illustrated in FIG. 3. This arrangement effectively provides four four-bar linkages, defined by axes 56,58 arms 60,62 and links 64. It will be appreciated that the line of motion of the displacer means in each link 64 is parallel to a line extending perpendicularly between the two axes 66 and 68 of each link which, in turn, is parallel to a reference line 70 extending perpendicularly between axes 56 and 58.

The rotary members 52 and 54 may be of a variety of different configurations. One or both may be in the form of a shaft having a plurality of radially outwardly extending arms as shown in FIG. 4, one or both may be in the form of a disc, cam or gear. Three alternative configurations are described in the description which follows. In addition, the following description will set forth the manner in which fluid is delivered to and from the fluid chambers.

FIGS. 5, 6 AND 7

Figure 7:
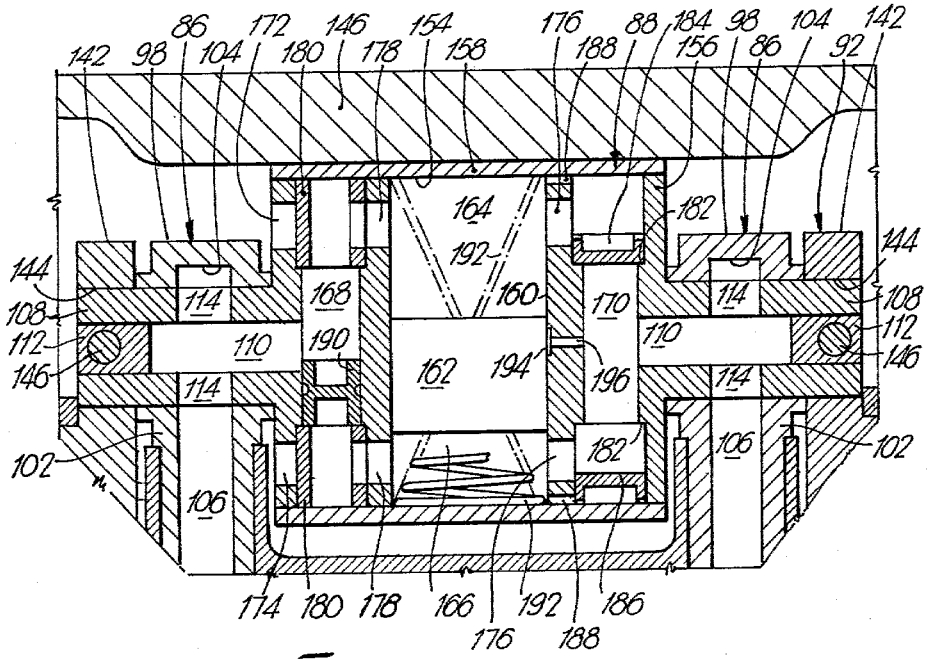
FIG. 7 is an enlarged longitudinal cross-sectional view of the body means of FIG. 5.
Figure 6:
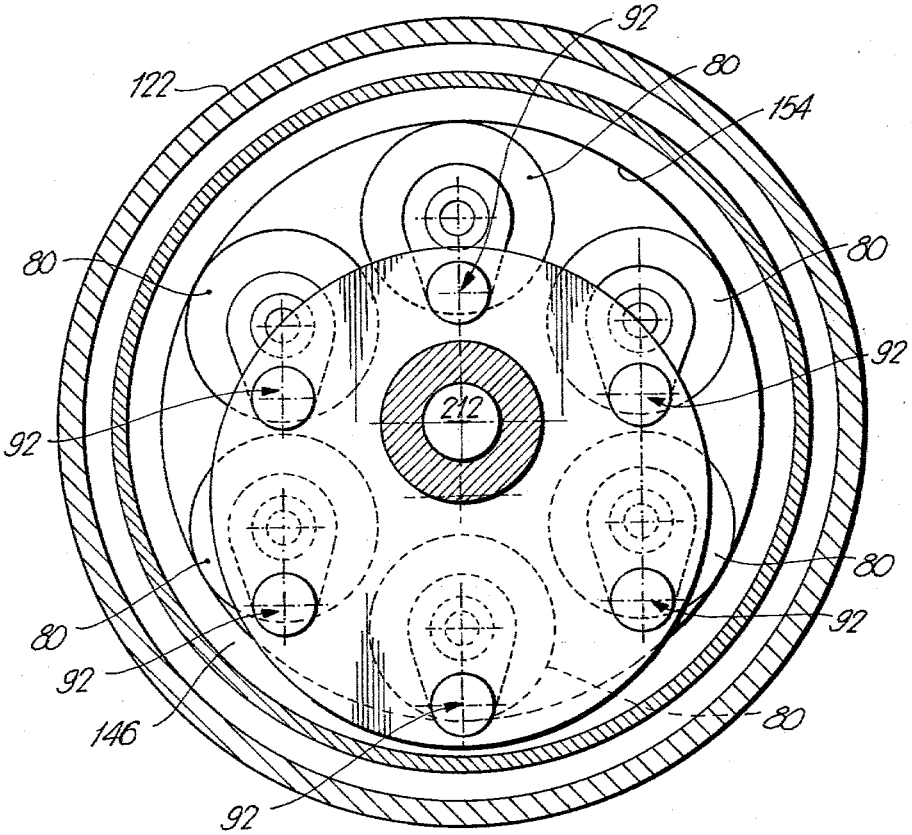
FIG. 6 is a cross-sectional view taken along line 6—6 of FIG. 5.

In the configuration illustrated in FIGS. 5, 6 and 7, the body means is in the form of six cylindrical piston carriers, each having a concentric journal and an eccentric journal or crankarm at each end. The displacer means in each piston carrier includes a piston movable in the direction of eccentricity of the eccentric journals or crankarms. One rotary member is comprised of a shaft having two sets of six radially outwardly extending drive arms having a bearing at their outer ends adapted to receive a concentric journal of a piston carrier. The other rotary member is comprised of a pair of discs eccentrically mounted for rotation on the shaft, and providing six equally spaced bores defining bearings each adapted to receive the crankpin of a crankarm of a piston carrier. The eccentricity of the disc axis relative to the shaft is of the same direction and magnitude as that of the crankarms. Communicating passages in the shaft, drive arms, concentric journals and piston carrier define the aforementioned fluid inlet and outlet passages. These features will become apparent from the following description.

While the embodiment of FIGS. 5, 6 and 7 is with reference to a pump, it is to be understood that it is equally applicable to a motor. It will be understood that in motor applications, appropriate pairs of valves operating independently of fluid pressure must be provided.

The pump 80 includes a drive shaft 82 journaled for rotation in a housing 84 in a manner to be described later. Two axially spaced sets of six equally, angularly spaced radially, outwardly extending drive arms 86 are mounted on shaft 82. Positioned between and mounted upon the outer end of an arm from each set is a cylindrical piston carrier 88. Rotatably mounted on shaft 82 on the side of each set of drive arms 86 remote from carriers 88 are eccentric disc assemblies 90 which are connected to each piston carrier 86 by a crankarm assembly 92.

Shaft 82 and arms 86 constitute a first rotary member, eccentric disc assemblies 90 constitute a second rotary member, piston carriers 88 and crankarm assemblies 92 constitute a body means or link and housing 84 constitutes a frame as previously discussed.

Shaft 82 is formed with a pair of spaced annular flanges 94 each of which is provided with six equally angularly spaced radial bores 96. Each drive arm 86 is formed with a generally annular head portion 98 defining an axial bearing bore 100 and a cylindrical body portion 102 extending radially from the head portion and sized to be received in a bore 96 of a flange 94. A circumferential groove or slot 104 is formed in the bearing bore 100 and it communicates with an axial bore 106 in the body portion 102. Groove 104 and bore 106 define fluid flow passages.

Each piston carrier 88 is formed with an axial stub shaft 108 at each end defining a journal sized to be rotatably received in bore 100 in a drive arm 86. Each shaft 108 is formed with an axial fluid passage 110 closed at its outer end by a plug 112. Diametrically extending holes 114 are formed in shafts 108 and are adapted to communicate with groove 104 of its associated drive arm.

Each eccentric disc assembly 90 includes an idler journal 116 and an idler disc 126. The left hand idler journal 116 is secured to casing end cover 118, by means of dowels 120, which, in turn, is secured to pump casing 122 of housing 84 by means of casing end cover dowels 124. The right hand idler journal 116 is secured to the pump casing 122 by means of dowels 128. Both idler journals 116 are formed with a bore 130 which define a bearing for each end of shaft 82 as shown. Additionally, both idler journals 116 have a concentric journal surface 132 and an eccentric journal surface 134. The purpose of the concentric journal surface will be described later.

Each idler disc 126 is of annular configuration having a bearing bore 136 sized to be rotatably received upon the eccentric journal surface 134 of one of the idler journals 116. Each idler disc 126 further includes six equally angularly spaced longitudinal bores 138 defining bearings for the crankpin 140 of six idler arms 142. The radial distance of the axis of the bores 138 to the axis of rotation of the idler disc must equal to that of the piston carrier 88 with respect to shaft 82.

Each idler arm 142 is formed with a hole 144 sized to receive the end of a stub shaft 108. Taper pins 146 secures the idler arms 142 to stub shaft 108 and also serves to retain plug 112 sealingly engaged in passages 110. It will be understood that the idler arms 142 may be formed integrally with stub shafts 108, thereby defining the crankarms. However, so doing would require forming the head portion 98 of drive arms 86 in two pieces.

It will also be understood that the eccentricity of the crankpin with respect to the axis of the piston carrier is the same as that of the eccentricity of axis of the idler disc 126 with respect to the axis of shaft 82. The purpose of slidingly mounting the drive arms 86 in bores 96 should now be evident. It not only simplifies manufacture, but it also precludes the necessity of high tolerances to permit free rotation of the arms and discs about their respective axes and considerably reduces stresses and strain in the various elements. In so doing, however, means must be provided for carrying the centripetal loads. To this end there is provided a tubular bearing ring 146 concentric with respect to the shaft 82. Each end of the ring 146 is connected to a bearing disc 148 by means of screws or dowels 150. Each disc 148 is formed with a bearing 152 sized to rotatably receive the concentric journal surface 132 of an idler journal 116.

Bearing ring 146 has a concentric inner bearing surface 154 and its radius is equal to the outermost distance of the piston carrier 88 to the axis of shaft 82. Thus, the centripetal loads of the drive arms and piston carriers is transmitted to the bearing ring 146 which, in turn, transfers the loads to the bearing discs 148 and, thence, to the idler journals and housing.

The piston carriers 88 will now be described with reference to FIG. 7. Each piston carrier is comprised of a cylindrical body 156, from each end of which extends the aforementioned stub shafts 108, and an annular sleeve 158. A transverse bore 160 extends through body 156 and defines with sleeve 158 an internal cavity in which a piston 162 is received for free sliding movement therein. The piston 162, bore 160 and sleeve 158 together define a pair of opposed fluid chambers 164 and 166.

Extending parallel to on both sides of bore 160 are through fluid pasages 168 and 170 which communicate with axial passages 110 in adjacent stub shafts 108. Longitudinal holes 172 and 174 intersecting passages 168 and 170 and bore 160 are drilled from the left hand end of body 156 and these define inlet and outlet ports 176 and 178, respectively, for each chamber 164 and 166. The holes in the left hand end wall of the body 110 are closed by sleeves 180 received in passage 168 and are retained therein by sleeve 158.

The outer ends of the fluid passage 170 are enlarged so as to define seats 182 for inlet slide valves 184 and 186. A small passage 188 connect each chamber 164 and 166 with the adjacent enlarged portion of passage 170 for operating the slide valves as will be discussed later. An outlet slide valve 190 is positioned in passage 168 and serves to open or close one or the other of the outlet ports 178.

A conical spring 192 is positioned in each chamber 164 and 166 and serves to center the piston 162 in bore 160. Alternatively, and probably more practical, is to provide an annular circumferential groove 194 in the center of bore 160 communicating with inlet passage 170 by means of a small passage 196. If the piston has a mean position away from the cylinder center, then the different lengths of the leakage paths from each end of the piston to the groove 194 causes a difference in the leakage flow resulting in the applying of a force upon the piston tending to center it in the bore 160.

For purposes of providing communication with an external source of fluid and external fluid circuitry, a blind axial bore 198 is provided in shaft 82. Bore 198 opens to the exterior at the right hand end of shaft 82 and defines thereat a fluid inlet opening 200 adapted to be connected to a source of fluid (not shown). Bore 198 extends to but not through the other end of the shaft 82. An outlet port end cover 202 is secured to the casing end cover 118 and includes a housing outlet port 204 and a bore 206 which receives the left hand end of shaft 82. A circumferential groove 207 in bore 206 provides fluid communication between outlet port 204 and bore 198 of shaft 82 via a diametrical hole 208 in shaft 82.

Bore 198 of shaft 82 is divided into inlet passage 210 and outlet passage 212 by means of a drive shaft plug 214. An inclined passage 216 in left hand flange 94 opens into outlet passage 212 of shaft 82 and communicates with bore 106 of the drive arms 86 via a hole 218 in the body portion of arms 86. The inner ends of passages 106 of drive arms 86 in left hand flange 94 are closed by means of plugs 220.

Drive shaft plug 214 is of cylindrical configuration and is sealingly received in bore 198 of shaft 82 adjacent left hand flange 94. It is provided with a transverse bore 222 with a diameter corresponding to that of bore 96 in flange 94 which receives a cylindrical plug retainer 224 whose length is greater than the diameter of bore 198 for retaining the plug 214 in the position shown. Retainer 224 has an axial fluid passage 226 which communicates with inlet passage 210 of shaft 82 via aligned ports 228 and 230 in the retainer and plug respectively. Thus any leakage from the high pressure side of the radially slidable drive arms is fed back to the low pressure side of the pump via passage 226 and ports 228 and 230. The plug 214 and retainer 224 are secured together by a bolt 232.

Thus, there is provided an inlet flow passage comprised of opening 200, inlet passage 210 in shaft 82, bores 96 in right hand flange 94, bore 106 and groove 104 in drive arms 86 in right hand flange 94, passage 110 and holes 114 in shaft 108, inlet fluid passage 170 and inlet ports 176 opening into chambers 164 and 166.

Similarly, there is provided an outlet fluid passage comprised of outlet ports 178, passage 168 in carrier 88, passages 110 and 114 in shaft 108, groove 104 and bore 106 in drive arms 86, passage 216 in flange 94, outlet passage 212 and hole 208 in shaft 82, groove 207 and housing outlet port 204 in outlet port end cover 202.

OPERATION

As mentioned earlier, counterclockwise rotation of shaft 82 as viewed in FIG. 6 will cause a torque to be transmitted to stub shafts 108 of piston carriers 88 via drive arms 86. This torque is, in turn, transmitted to idler discs 126 via idler arms 142. Thus, the idler discs 126 are caused to rotate upon the eccentric journal surfaces 134 of idler journals 116 about an axis parallel to but spaced from that of shaft 82. Because the idler arms 142 are fixedly secured to stub shafts 108 by tapered pins 109 and the crankpins 140 are free to rotate in bearing 138, a clockwise (FIG. 6) torque will be transmitted to stub shafts 108 by the idler arms 142, tending to rotate shafts 108 and carriers 88 in a clockwise direction as viewed in FIG. 6 in bearings 100 of drive arms 86. This clockwise rotation will be at the same rate as that of counterclockwise rotating shaft 82. Thus, the line of motion of pistons 162 is maintained fixed with respect to a fixed frame of reference or line, that line extending perpendicularly between the axis of shaft 82 and the axis of rotation of idler disc 126 which in turn is in the direction of the eccentricity of idler arms 142.

The centripetal loads of the piston carriers 88 and drive arms 86 are taken primarily by the bearing ring 146 and discs 148 as explained earlier. Furthermore, by virture of frictional engagement between the bearing surface 154 and the other surface of sleeve 158 will cause bearing ring 146 to rotate in the direction of rotation of shaft 82 but at only a fraction of the rate.

The position of piston 162 in FIG. 5 corresponds to position B illustrated in FIG. 2 although it will be appreciated that the piston in FIG. 5 is moving outwardly toward chamber 164. The description which follows pertains particularly to the piston carrier shown in FIG. 5 but it will be understood that it is equally applicable to the five other piston carriers bearing in mind that they will be out of phase with the FIG. 5 carrier by multiples of 60°.

With piston 162 beginning to move outwardly, the volume of chamber 164 will decrease and that of chamber 166 will increase. The pressure rise in chamber 164 will be conveyed to the slide valve 184 via passage 188 to cause slide valve 184 to become seated in seat 182 and thereby close inlet port 176 of chamber 164. The increase in pressure in chamber 164 will also be conveyed to outlet slide valve 190 to cause it to move to a position opening outlet port 178 of chamber 164 and closing outlet port 178 of chamber 166 as shown in FIG. 5. Thus, fluid is free to flow outwardly of chamber 164 via outlet port 178 and inwardly of chamber 166 via inlet port 176. As the piston 162 continues to move outwardly, chamber 164 will continue to be exhausted as fluid flows to the housing outlet port 204 via the aforedescribed fluid outlet passages and chamber 166 will continue to be filled as fluid flows from the housing inlet opening 200 via the aforedescribed inlet passages.

Once shaft 82 has rotated through 180° from the position illustrated in FIG. 5, piston 162 will have reached the end of its stroke and will commence moving in the opposite direction and cause chamber 166 to be exhausted and chamber 164 to be filled in precisely the small manner described above.

Figure 8:
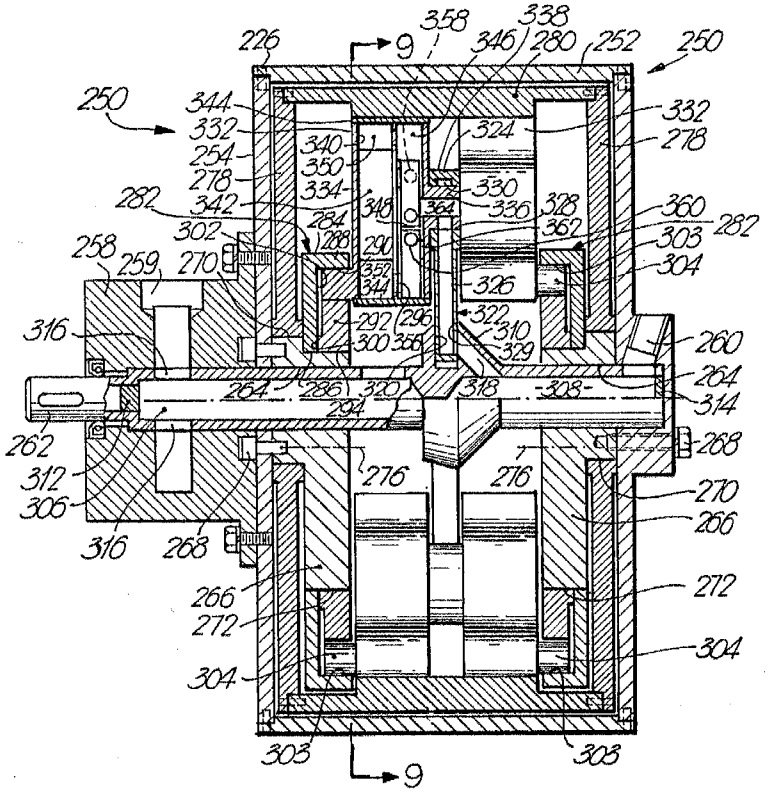
FIG. 8 is a longitudinal cross-sectional view of another practical embodiment of the invention.
Figure 9:
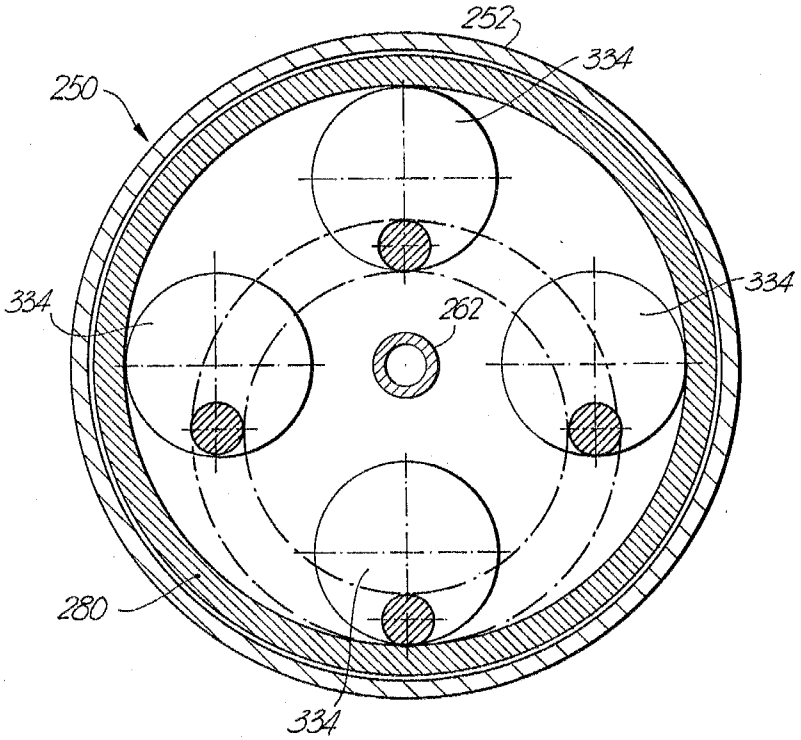
FIG. 9 is a cross-sectional view taken along line 9—9 of FIG. 8.

FIGS. 8 and 9

The configuration illustrated in FIGS. 8 and 9 is similar to that of FIGS. 5 and 6 with the basic exception that rather than providing a pair of drive arms for supporting each piston carrier, a single drive arm supports and drives a pair of axially aligned cylindrical piston carriers and the piston carriers are connected directly to the idler discs rather than by the intermediary of idler arms. Furthermore, fluid is fed to inlet ports in the piston carriers from a sealed chamber formed by the bearing ring and discs.

As shown in FIG. 8, the pump 250 includes a housing or casing 252, a casing end cover 254 secured to casing 252 by means of bolts or dowels 256 and a port end cover 258. These elements are substantially the same as those of the previous embodiment and therefore need not be discussed further. However, it should be noted that the fluid inlet 259 is by way of port end cover 258 to the left in FIG. 8 and an outlet port 260 is formed integrally with casing 254 to the right as shown in FIG. 8.

Mounted for rotation in the casing 252 is a shaft 262. The shaft is journaled in a bore 264 of each of two idler journals 266 disposed at either end of the casing 252. The idler journals 266 are secured to the casing by means of appropriate bolts, screws, dowels or the like 268. The idler journals are each formed with a pair of cylindrical journal surfaces 270 and 272. Journal surface 270 is concentric with respect to axis 274 of shaft 262 while journal surface 272 is eccentric with respect to axis 274. The center of cylindrical journal surface 272 is shown as axis 276 parallel to axis 274.

As with the previous embodiment, a bearing disc 278 is mounted for rotation upon each of the concentric journal surfaces 270 and a bearing ring or cylinder 280 is secured to the outer circumferential edge of the discs by means of suitable pins, screws or bolts. Journaled for rotation upon each of the eccentric journal surfaces 272 of each idler journal is an idler disc 282 and each idler disc is of two-piece construction including a first idler disc member 284 having a bore 286 for receiving eccentric journal 272 and an annular flange 288 defining an inner circumferential bearing surface 290 and a second idler disc member 292 having a bore 294 for receiving eccentric journal 272 and an outer circumferential bearing surface 296. Member 292 is formed with a hub 298 defining a bearing surface 300 which bears against surface 302 of member 284. Surfaces 290 and 296 together cooperate to define an annular groove 303 to receive a follower member 304 attached to the piston carrier.

Shaft 262 is formed with axial blind bores 306 and 308 extending from each end, each terminating adjacent a centrally, disposed radially outwardly extending annular flange 310. As shown, the bores 306 and 308 are closed at their ends by appropriate plugs 312 and 314. Bore 306 is in fluid communication with a casing inlet port 259 in the port end cover 258 and communicates with the interior of the casing by means of a pair of radial holes 316. One end of bore 308 is in fluid communication with casing outlet port 260 while the other end communicates with inclined fluid passageways 318 in flange 310. Flange 310 is formed with radially outwardly extending bores 320 into which passageways 318 open.

Drive arms 322 are similar in construction and mounting as that of the previous embodiment. Each is formed with a cylindrical head portion 324 from which extends a cylindrical body portion 326 as shown. The head portion 324 is formed with an axial bore 328 surrounded by an annular slot or groove 330. The body portion 326 is sized to be slidingly received in radial blind bores 320 in flange 310 and is formed with an axial passage 329 communicating with bores 328 and 318.

As mentioned earlier, a pair of piston carriers 332 are mounted upon the outer end of each drive arm 322. The piston carriers 332 are in the form of a pair of cylindrical body members 334 joined by an axial cylindrical shaft portion 336 which is received in bore 328 of drive arm 322. For mounting purposes, the head portion 324 of the drive arm is formed with a removable cap 338. Each body member 334 is formed with a through bore 340 in which a cylindrical piston 342 is mounted for free sliding movement, the ends of which as in the previous embodiment are closed by means of concentric carrier sleeves 344.

Each body member 334 is also formed with a second through bore 346 whose ends are also closed by sleeve 344 and which carry a conventional slide valve 348. The slide valves are well known and their construction and operation need not be described in detail.

Bore 340 and piston 342 define a pair of opposed chambers 350 and 352. A port 354 connects chamber 350 with the adjacent end of bore 346 while a port 356 connects chamber 352 with its adjacent end of bore 346 and the slide valve separates the two ports from one another. A pair of inlet ports 358 and 360 open from the exterior of each piston carrier into the ends of bore 346 so as to provide fluid communication between chambers 350 and 352. The slide valve 348 is formed with outlet ports 362 communicating chambers 350 and 352 with axial passage 364 in shaft portion 336 which in turn communicates with passage 329 in drive arm 322.

It will be understood that the slide valve 348 serves to selectively open or close one or the other of the inlet ports 358 and 360 depending upon the direction of motion of piston 342 and close or open exit passageway 364 to either of chambers 350 or 352.

OPERATION

The fluid flow through this device is as follows. Assuming the piston is moving upwardly in FIG. 8, chamber 350 will become pressurized to thereby cause slide valve 348 to move to the position shown where exit passageway 364 is open to chamber 350 through the intermediary of bore 346 and chamber 352 is open to the exterior of the carrier and the interior of the pump by means of passageway 360. Such positioning and motion will cause fluid to flow inwardly by way of inlet 259, bore 306 and holes 316 into the interior of the housing and onward into chamber 352 through passages 360 and 346. Concurrently, fluid flows outwardly of chamber 350, by way of passages 346, 364, 329, 318, bore 308 and outlet port 260. It will be appreciated that when piston 342 has reached the end of its stroke and begins to move downwardly in FIG. 8, the slide valve will be moved to the other end of the passage 346 thereby causing chamber 350 to receive fluid and chamber 352 to exhaust fluid. Antichurning discs (not shown) are preferably provided to minimize energy losses. Ball check valves 366 prevents reverse flow of fluid.

As shown in FIG. 9, this configuration is formed with four drive arms 322 and, therefore, has eight piston carriers 334. However, more or less drive arms and carriers may be provided as desired.

While the idler discs 282 have been described as being of two-piece construction and rotatable upon eccentric journal surfaces 272 of idler journals 266, they may also be formed of one-piece construction or made integral with the idler journals without significantly affecting the performance of the device.

Mechanically, this configuration will be seen to operate in a manner similar to that of the previous configurations. Counterclockwise rotation of shaft 262, as viewed in FIG. 8, will cause a torque to be transmitted to the piston carriers 332 via arms 322 and shafts 336. Thus, the piston carriers will rotate about axis 274 of shaft 262. The torque will in turn be transmitted to idler discs 282 via body members 334 of carriers 332 and followers 304, to thereby cause the discs to rotate about axis 276 of eccentric journal surfaces 272 of stationary idler journals 266. Since the cam grooves defined by the idler discs remain concentric with respect to axis 276, followers 304 will cooperate therewith to cause the carriers 332 to rotate in a clockwise direction about the axis of their respective shafts 336 at the same angular speed of the shaft 262. More specifically, the line of motion of the various pistons will be maintained fixed relative to a fixed frame of reference as previously explained.

Figure 11:
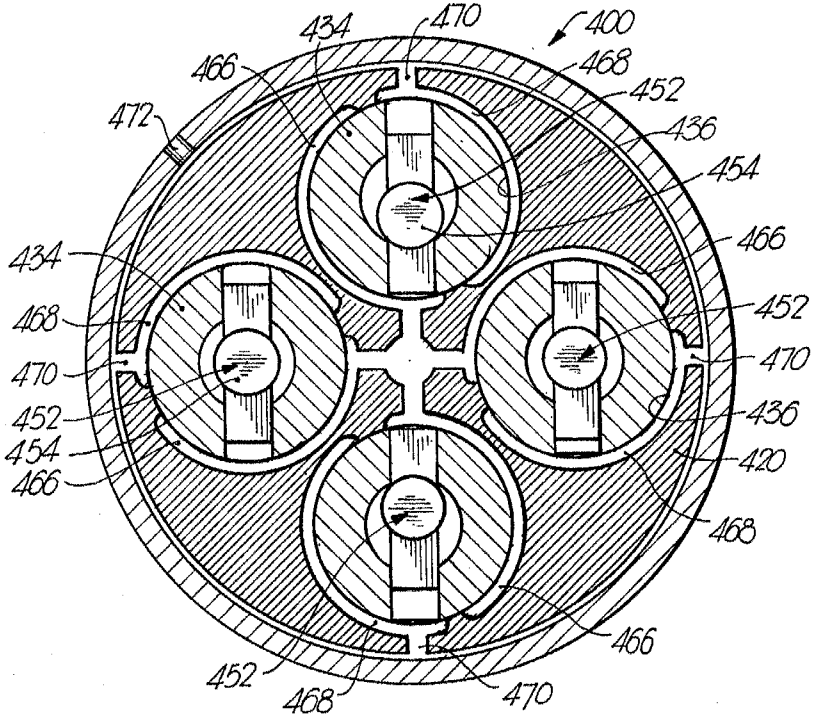
FIG. 11 is a cross-sectional view taken along line 11—11 of FIG. 10.

FIGS. 10, 11 and 12

This configuration differs from the previous configurations in that it is comprised of fewer moving parts and is of simple and compact construction.

As best shown in FIG. 10, this configuration is comprised of a pump casing 400 having a right hand casing end cover 404 and a left hand casing end cover 402 secured to the casing by means of screws, bolts, dowels or the like 406. End covers 402 and 404 are formed with an inwardly directed hubs 408 and 410 which define bearings 412 and 414 for journal portion 416 and 418 of a drive plate 420 and eccentric journal surfaces 422 and 424 upon which are mounted bearings 426 and 428 of idler discs 430 and 432. Four piston carriers 432 are mounted in drive plate 420 and idler discs 430 and 432 as will hereinafter be described.

Drive plate 420 is formed with four equally, angularly spaced bearing bores 436 while idler discs 430 and 432 are formed with four equally, angularly spaced bearing bores 438 and 440, respectively. The radial distance of the bearings from axis of rotation of the discs is the same as that of the drive arms, it being understood that the axis of the idler discs is parallel to but spaced from the axis of the drive arm.

As shown in FIG. 12, each piston carrier 434 is formed with a main journal surface 442 and a pair of opposed eccentric journal surfaces 444 and 446. The eccentricity of journal surfaces 444 and 446 is identical to the eccentricity of the axis of the idler discs with respect to the axis of drive plate 420. Main journal 442 is sized to be received for rotation in a bearing 436 of drive plate 420 while eccentric journal surfaces 444 and 446 are sized to be received for rotation in bearings 430 and 440 in discs 430 and 432, respectively. Each carrier is formed with an axial bore 448 and a transverse bore 450. A cylindrical piston 452 is sized to be received in bore 450 for axial sliding movement therein. A central weight 454 may be added to the piston 452 for movement movement in transverse bore 448 if additional mass is required or desired. As best shown in FIGS. 10 and 11, the piston carriers 434, end faces of piston 452 and bearings 436 of drive plate 420 define fluid chambers 456 and 458.

The drive plate 420 is formed with an axial fluid inlet passage 460 aligned with a housing inlet port 462 and four radially outwardly extending fluid passages 464 each opening into an inlet port 466 in a bearing 436. Ports 466 are arcuate in nature extend slightly less than 180° degrees around bearings 436 as shown in FIG. 11. Similar outlet ports 468 are formed in bearings 436 and communicate with the interior of casing 400 via radial passages 470. A housing outlet port 472 is provided in casing 400 as shown in FIG. 11.

Thus, it will be seen that drive plate 420 constitutes one rotary member, idler discs 430 and 432 constitute a second rotary member, and piston carriers 434 constitute a link or body means. The pistons 452 are movable along a line parallel to the direction of eccentricity of the eccentric journals. It will be understood that it is important that the line of motion of the pistons remain parallel to a fixed frame of reference and not essential that they be movable in the direction of eccentricity.

OPERATION

With the pistons in the positions shown in FIG. 10, and drive plate rotating in a counterclockwise direction, it will be understood that a drive plate 420 will transmit a torque to the piston carriers 434 via bearings 436 and that this torque will in turn be transmitted to the idler discs 430 and 432 via eccentric journals 444 and 446, respectively, of carriers 434. Rotation of the drive plate and idler discs about their spaced axes will cause the piston carriers to rotate in a clockwise direction relative to the direction of rotation of the drive plate and idler discs but to maintain the line of motion of the pistons fixed with respect to a fixed frame of reference, such as the casing for example. As explained earlier, such motion will cause the pistons 452 to reciprocate thereby varying the volume of the fluid chambers 456 and 458 to cause fluid to flow inwardly thereof via housing inlet port 462, axial passage 460 and radial passages 464 in drive plate 420 and inlet ports 466 and outwardly thereof via outlet port 468, passages 470, casing interior and housing outlet port 472.

It will be seen that the present invention is susceptable to many alternative configurations, modifications, constructions and applications. An of these are intended to be covered by the appended claims.

The embodiments of the invention in which an exclusive property or privilege is claimed are defined as follows:

1. A fluid energy transfer device, comprising:

at least one body means having at least one expansible fluid chamber and fluid inlet and outlet passages for delivering fluid to and from said chamber;

first rotary means rotatably mounted to said body means at a first pivot axis for rotating said body means about a first fixed axis, the first pivot axis being located at a distance remote from said first fixed axis;

second rotary means rotatably mounting said body means at a second pivot axis for rotating said body means about a second fixed axis, the second pivot axis being located at a distance remote from said second fixed axis, which distance is equal to said distances between the first fixed axis and the first pivot axis, said second fixed axis being spaced from and parallel to said first fixed axis, and said first and second rotary means being effective to maintain said body means in a fixed attitude with respect to a fixed frame of reference said chamber and passages being arranged in said body means such that as said body means rotates about said fixed axes fluid flows inwardly and outwardly to and from said chamber via said inlet and outlet passages.

2. A fluid energy transfer device as claimed in claim 1, said body means being constrained radially toward said first fixed axis by an annular ring means constrained to rotate about said first fixed axis.

3. A device as defined in claim 2, further including a displacer means in said chamber.

4. A device as defined in claim 3, said displacer means including a piston means freely slidable in said chamber.

5. A device as defined in claim 4, each said piston having additional weight means to increase its mass.

6. A device as defined in claim 1, said first rotary means being at least one arm, said at least one arm being rotatable at one end about said first fixed axis and rotatably mounting said body means about said first pivot axis at its other end therefor.

7. A device as defined in claim 6, further including a shaft, said at least one arm means being mounted on said shaft for rotation therewith, said rotary means being eccentrically mounted on said shaft for rotation thereon.

8. A device as defined in claim 7, said body means being cylindrical and extending parallel to said shaft, said chamber being cylindrical and extending transversely in said body means.

9. A device as defined in claim 8, said body means having a journal member having a first cylindrical journal surface extending from each end, said at least one arm means including a pair of drive arms axially spaced on said shaft and extending radially outwardly therefrom, each said drive arm having a bearing at its outer end for receiving a journal member.

10. A device as defined in claim 9, each said journal member having a second cylindrical journal surface eccentric with respect to said first journal surface by an amount equal to and in the same direction as that of said second arm means on said shaft, said second arm means having a bearing for receiving said second journal surface.

11. A device as defined in claim 10, said journal members and drive arms having communicating fluid passages, said shaft having a first axial fluid passage communicating with the fluid passage in one of said drive arms and a second axial fluid passage communicating with the fluid passage in the other of said drive arms, the fluid passage of one of said drive arms communicating with said inlet fluid passage in said body means and the fluid passage in the other of said drive arms communicating with the other fluid passage in said body means.

12. A device as defined in claim 11, said inlet and outlet fluid passages in said body means including valve means responsive to fluid pressure in said chamber to open or close said passages.

13. A device as defined in claim 7, said body means having a pair of coaxial cylindrical piston carriers connected by an axial journal member extending parallel to said shaft, each said carrier having a transverse cylindrical internal cavity and a piston means slidable in said cavity.

14. A device as defined in claim 13, said first arm means extending radially outwardly of said shaft and having a bearing at its outer end for receiving said journal member.

15. A device as defined in claim 13, each said piston carriers having an eccentric, longitudinal journal member extending longitudinally thereof, said second arms means having a bearing at their outer ends for receiving one said eccentric journal members.

16. A device as defined in claim 15, wherein the eccentricity of said eccentric journal members being equal to the eccentricity of said second arms.

17. A device as defined in claim 16, said first arm means having a fluid passage communicating with the inlet fluid passage of each said piston carrier, said shaft having a first fluid passage communicating with a source of fluid and first arm means fluid passage.

18. A device as defined in claim 17, said shaft having a second fluid passage communicating with an external fluid circuit and the outlet fluid passage of each said piston carrier.

19. A device as defined in claim 1, said first rotary means being a disc rotatable about said first axis.

20. A device as defined in claim 6, said second rotary means being an arm rotatable at one end about said second axis and rotatably mounting at the other end of said body means, the effective length of said arm being the same as that of said first rotary means.

21. A device as defined in claim 6, said second rotary means being a disc rotatable about said second axis and rotatably mounting said body means at a distance from said second axis equal to that of said first rotary means.

22. A device as defined in claim 6, at least one of said rotary means having fluid passages communicating said chamber with a source of fluid.

23. A device as defined in claim 6, said rotary means providing fluid flow passages communicable with said chamber.

24. A device as defined in claim 1, wherein said second rotary means is adapted to rotate at substantially the same rate as said first rotary means.

25. A device as defined in claim 1, further including fluid rectifier means in each said passages permitting fluid flow in one direction and resisting flow in the opposite direction.

26. A device as defined in claim 1, said device further including a housing, a shaft mounted in said housing for rotation therein, said first rotary means being mounted on said shaft for rotation therewith, said at least one body means including a plurality of pairs of cylindrical piston carriers equally angularly spaced about said shaft, the axis of each of said piston carriers extending parallel to said shaft, each said piston carrier having a transverse bore defining said at least one fluid chamber, and valve means in said passages for controlling the flow of fluid to and from said chamber.

27. A device as defined in claim 26, said first rotary means comprising a disc providing a bearing for a journal portion of each said pair of piston carriers.

28. A device as defined in claim 26, said first rotary means comprising a drive arm associated with each said pair of piston carriers, each said drive arm extending radially outwardly of said shaft, and, each said pair of piston carriers being rotatably mounted at the end of one of said drive arms.

29. A device as defined in claim 28, said second rotary means comprising an idler disc;

said idler disc having a circular groove eccentric with respect to said shaft;

the radius of the center of said groove being equal to the effective radial distance of said rotary means; and, each said pair of said piston carriers having a follower associated with and movable along said groove during rotation of said shaft.

30. A device as defined in claim 29, said idler disc being unitary and secured to said housing.

31. A device as defined in claim 29, further including an idler journal providing an eccentric journal surface, said idler disc being rotatably mounted on said journal surfaces.

32. A device as defined in claim 31, said idler journal being secured to said housing.

33. A device as defined in claim 31, said idler journal being secured to said shaft for rotation therewith.

34. A device as defined in claim 31, said drive shaft having an axial fluid inlet passage and an axial fluid outlet passage; and, each said drive arms having a fluid passage communicating between said outlet passage in its associated pair of piston carriers and the fluid outlet passage in said shaft.

35. A device as defined in claim 34, said inlet fluid passage in each said piston carrier communicating with the interior of said housing, said shaft fluid inlet passage communicating with the interior of said housing.

36. A device as defined in claim 35, each said drive arm being mounted on said shaft for radial movement;

said device further including:

tubular energy absorbing means rotatably mounted in said housing; and, said absorbing means being adapted to carry the centripetal forces produced by said piston carriers and said drive arms.

37. A device as defined in claim 36, each said piston carrier having a piston mounted in said transverse bore for free sliding movement therein; and, said piston being adapted to reciprocate in said transverse bore in response to rotation of said shaft.

38. A device as defined in claim 1, further including a housing, said first rotary means being a drive plate mounted in said housing for rotation therein about said first fixed axis, said second rotary means being an idler disc mounted in said housing on opposte sides of said drive plate for rotation about said second fixed axis, each said drive plate and idler discs having an equal number of equally angularly spaced cylindrical bearings spaced from their respective axes, said at least one body means including a piston carrier means associated with said bearings, each said piston carrier means having a main journal sized to be rotatably received in a bearing of said drive plate and a pair of eccentric journals on opposite sides of said main journals sized to be rotatably received in a bearing of one of said idler discs, the eccentricity of said journals being of the same magnitude and direction as that of said idler discs with respect to said drive plate, each said piston carrier means having a transverse bore, a piston mounted in said transverse bore for free sliding movement therein in response to rotation of said drive plate and defining a pair of opposed fluid chambers with its associated carrier and said drive plate, said fluid inlet passages being formed in said drive plate and opening into said drive plate bearings whereby each said chamber is placed in fluid communication with said inlet fluid passages in turn during each revolution of said shaft.

39. A fluid energy transfer device, comprising:

a housing;

a shaft mounted in said housing for rotation therein;

a plurality of cylindrical piston carriers extending parallel to said shaft and equally angularly spaced about said shaft for rotation therewith, each said carrier having an axial cylindrical journal member at each end;

a pair of drive arms associated with each said carrier, said drive arms being mounted on and axially spaced along said shaft for rotation therewith and extending radially outwardly therefrom, each said drive arm having a bearing at its outer ends for receiving a journal member of one of said carriers;

a pair of axially spaced idler disc members eccentrically mounted to said shaft for rotation, and having a plurality of equally angularly spaced bearing surfaces;

an idler arm associated with each said journal member and defining an eccentric cylindrical journal surface adapted to be received in one of said bearing surfaces of one of said idler disc members;

each of said piston carriers having;

an internal cylindrical bore extending transversely of the carrier axis;

piston means freely mounted in said bore for reciprocable sliding movement therein in response to rotation of said shaft and defining with said carrier a fluid chamber at each end of said piston means;

fluid inlet passages associated with each said chamber communicating with a source of fluid and fluid outlet passages associated with each chamber communicating with a housing outlet port; and, valve means associated with said passages for controlling flow of fluid into and out of said fluid chambers.

40. A device as defined in claim 39, said idler arms being removably secured to said journal members and the degree and direction of eccentricity with respect to said journal members being equal to that of said idler disc members with respect to said shaft.

41. A device as defined in claim 39, each said idler arms and associated journal member being unitary, and the degree and direction of eccentricity of said idler arms being the same as that of said idler disc members.

42. A device as defined in claim 39, said drive arms being secured to said shaft.

43. A device as defined in claim 39, said drive arms being mounted on said shaft for radial sliding movement, said device further including radial load absorbing means mounted on said shaft for rotation and engageable with each said carrier.

44. A device as defined in claim 43, said shaft having a pair of axially spaced radially outwardly extending cylindrical flanges carrying said drive arms, each said drive arm having a generally cylindrical head member and a cylindrical body member extending radially therefrom, each said flange having a plurality of radial bores each slidingly receiving the cylindrical body member of one of said drive arms, said head member having an axial bore defining said bearing.

45. A device as defined in claim 44, said head member defining with said body member an annular shoulder engageable with the circumferential surface of said flange for defining an inner limit of travel of said drive arm.

46. A device as defined in claim 45, said absorbing means including a tubular bearing cylinder concentrically mounted on said shaft for rotation, said bearing cylinder having an inner bearing surface engageable with the peripheral surface of said carriers.

47. A device as defined in claim 46, further including a pair of axially spaced bearing discs secured at their peripheral edges to the ends of said bearing cylinder and being journaled on said shaft for rotation thereon.

48. A device as defined in claim 47, said idler disc members each including an idler journal member having an eccentric cylindrical bearing surface for receiving a mating journal surface on said idler disc member, and an inner cylindrical journal surface received on said shaft.

49. A device as defined in claim 48, each said idler journal members having a concentric cylindrical bearing surface for receiving a mating journal surface of one of said bearing discs.

50. A device as defined in claim 49, fluid passages in said shaft, drive arms and piston carrier journal members communicating with said fluid inlet and outlet passages associated with said fluid chambers in said piston carriers.

51. A device as defined in claim 49, each said piston carrier including:

a cylindrical body member;

said cylindrical bore extending diametrically through said body member;

a cylindrical fluid passage extending diametrically through said body member parallel to said bore; and, a fluid port connecting the ends of each fluid passage with one end of said bore.

52. A liquid energy transfer device, comprising:

at least one body means having at least one liquid chamber and liquid inlet and outlet passages for delivering liquid to and from said chamber;

first rotary means rotatably mounted to said body means at a first pivot axis for rotating said body means about a first fixed axis, the first pivot axis being located at a distance remote from said first fixed axis;

second rotary means rotatably mounting said body means at a second pivot axis for rotating said body means about a second fixed axis, the second pivot axis being located at a distance remote from said second fixed axis, which distance is equal to said distances between the first fixed axis and the first pivot axis, said second fixed axis being spaced from and parallel to said first fixed axis, and said first and second rotary means being effective to maintain said body means in a fixed attitude with respect to a fixed frame of reference said chamber and passages being arranged in said body means such that as said body means rotates about said fixed axes liquid flows inwardly and outwardly to and from said chamber via said inlet and outlet passages.

* * * * *